United States Patent [19]

Tant

[11] 3,952,441

[45] Apr. 27, 1976

[54] CLIP FOR SEMI-AUTOMATIC FIREARM

[76] Inventor: William A. Tant, 1220 Daladams St., Raleigh, N.C. 27603

[22] Filed: Oct. 18, 1974

[21] Appl. No.: 515,882

Related U.S. Application Data

[63] Continuation-in-part of Ser. No. 350,747, April 13, 1973, Pat. No. 3,857,324.

[52] U.S. Cl. ..... 42/50; 42/18

[51] Int. Cl.[2] ..... F41C 25/02

[58] Field of Search ..... 42/50, 6, 7, 18

[56] References Cited

UNITED STATES PATENTS

| | | | |
|---|---|---|---|
| 980,980 | 1/1911 | Maggio | 42/50 |
| 2,217,848 | 10/1940 | Schillstrom | 42/50 |

FOREIGN PATENTS OR APPLICATIONS

| | | | |
|---|---|---|---|
| 569,280 | 2/1933 | Germany | 42/50 |
| 654,386 | 12/1937 | Germany | 42/50 |

*Primary Examiner*—Charles T. Jordan
*Attorney, Agent, or Firm*—Mills and Coats

[57] ABSTRACT

The present invention relates to a magazine for inserting one cartridge at a time into the chamber of a firearm. This magazine includes a pair of side-by-side cartridge chambers separated by a partition extending longitudinally through the magazine and laterally to a point in spaced relation to the rear wall of the magazine. This allows the cartridges in the magazine to lie juxtaposed to the partition until they move upwardly to converge, one at a time, to be fed in the firearm chamber.

4 Claims, 15 Drawing Figures

CLIP FOR SEMI-AUTOMATIC FIREARM

This ia a Continuation-In-Part of U.S. Pat. Application Ser. No. 350,747, filed Apr. 13, 1973, for Semi-Automatic Firearm now U.S. Pat. No. 3,857,324.

The present invention relates to firearms and more particularly to the class of firearms commonly referred to as semi-automatic.

Semi-automatic firearms are known and have been used by hunters, outdoorsmen, and sportsman in general. Generally semi-automatic firearms may come in the form of a rifle or a small handgun. By semi-automatic, one means that the firearm may be repeatedly fired, without cocking, by repeatedly actuating a trigger mechanism. Many semi-automatic firearms utilize the recoil movement of a bolt to urge a striker back into a cocked position after each firing.

To provide for repeated short interval firing, it is necessary to provide means for feeding cartridges one at a time into the receiver of the firearm, and means for extracting and ejecting the fired shell after each firing. Such feeding mechanisms are often in the form of a magazine clip and the extracting and ejecting of the shell has been accomplished in many ways.

Basically a semi-automatic firearm comprises three basic groups of mechanisms: (1) a firing and recocking mechanism, (2) a cartridge feeding mechanism, and (3) shell extracting and ejecting mechanism. In order for the firearm to operate properly, it is necessary that all of these mechanisms cooperate in timed relationship during the firing of the firearm.

In many semi-automatics, these mechanisms have been quite complex and have involved a great number of moving parts. This complexity has often resulted in the firearm requiring frequent repair and maintenance. Moreover, the likelihood of jamming and malfunctioning is often increased with firearms employing numerous sophisticated mechanisms with many moving parts.

In view of the foregoing, the present invention has been devised and presents a relatively simple semi-automatic firearm. The firearm comprises a bolt slidably mounted within a chamber formed in a receiver. The bolt carries an extractor and ejector assembly that is operative upon recoil of the bolt to engage and eject the fired shell. Also, the bolt upon recoil engages a striker and urges the latter back to a cocked position, after which the bolt is biased back toward a firing point. The bolt further carries a cartridge feed guide which engages the upper most cartridge of the magazine clip and urges the cartridge into the receiver and into the firing position. Consequently, after the positioning of the striker in the cocked position due to the recoil movement of the bolt, the firearm is made ready to fire.

In those cases where the striker has been released from the cocked position and there is no cartridge to furnish the recoil movement, the firearm of the present invention utilizes a manual finger lever which engages the bolt and urges the same back against the striker, moving the striker to the cocked position.

It is, therefore, an object of the present invention to provide a semi-automatic firearm that is relatively simple in construction, easy to operate, and functions reliably without malfunctioning or jamming.

A further object of the present invention resides in the provision of an improved firing mechanism for a semi-automatic firearm, said improved mechanism comprising an axially aligned striker and bolt assembly with said bolt being adapted to recoil and engage said striker to position the same in a cocked position in response to the firing of a cartridge.

Still a further object of the present invention is to provide a bolt assembly with a cartridge feed guide for positioning the individual cartridges within the receiver of the firearm for firing, and an extractor and ejector assembly carried by said bolt for extracting and ejecting fired shells from the receiver, said extractor and ejector assembly being actuated in response to the recoil movement of said bolt.

Figure 1:
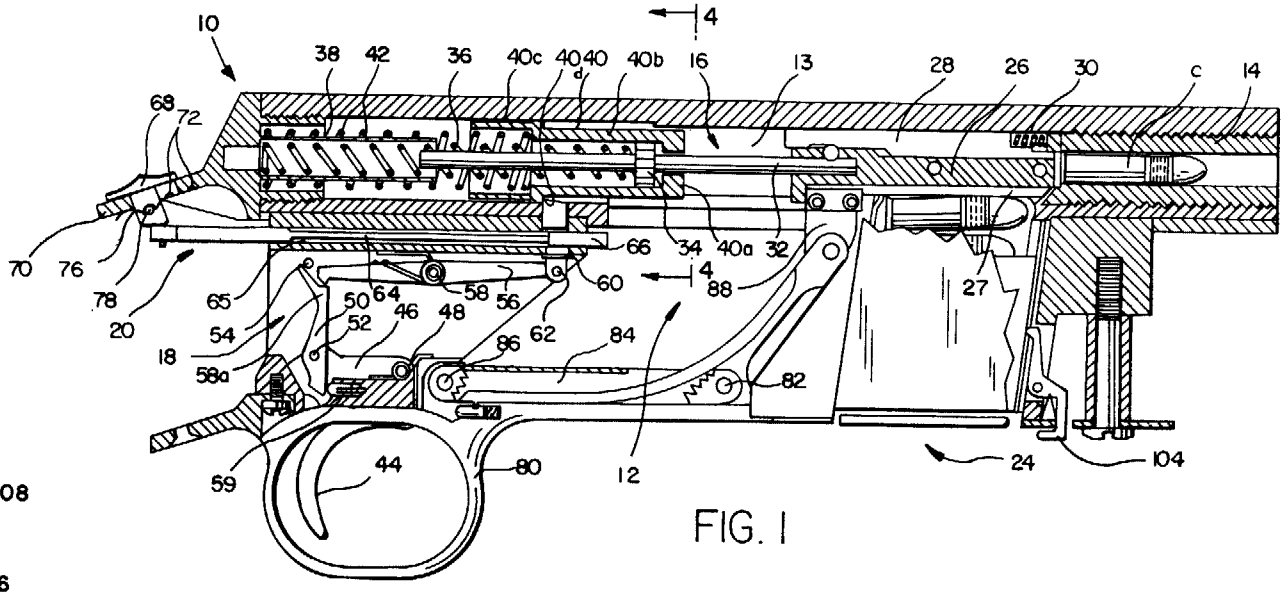
FIG. 1 is a side elevational view of the firearm receiver of the present invention with the outer housing structure being broken away to better illustrate the internal structure thereof.

With further reference to the drawings, particularly FIG. 1, the firearm of the present invention is shown therein and indicated generally at 10. The firearm 10 basically comprises a receiver 12 which has a longitudinal chamber 13 formed therein. Threaded into the front end of the receiver chamber 13 is a barrel 14 (only a portion of which is shown).

Insertable within the receiver 12 is a cartridge feed means 24 which is adapted to feed one cartridge at a time into the receiver 12.

Disposed within the receiver chamber 13 is a firing mechanism 16. The firing mechanism 16 is operatively connected to a trigger mechanism 18, the trigger mechanism being adapted to actuate the firing mechansim 16. Operatively associated with the trigger mechanism 18 is a safety interlock 20 which is particularly adapted to prevent inadvertent actuation of firing mechanism 16.

Figure 2:
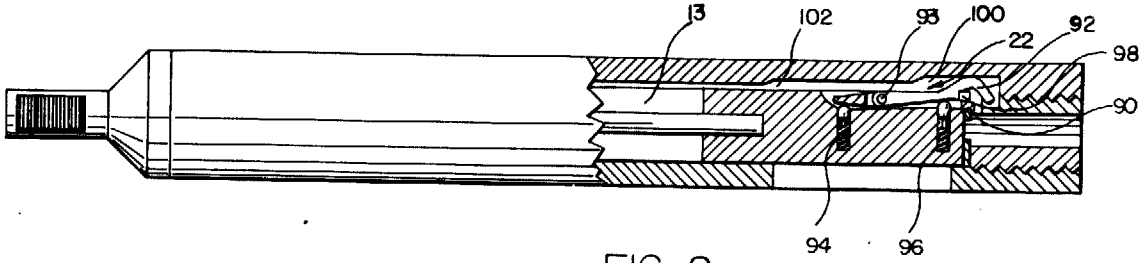
FIG. 2 is a top plan view of the firearm of the present invention with portions thereof being broken away to better illustrate the bolt, extractor and ejector assembly thereof.
Figure 14:
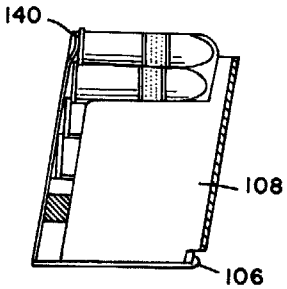
FIG. 14 is a longitudinal cross sectional view of the magazine clip.
Figure 15:
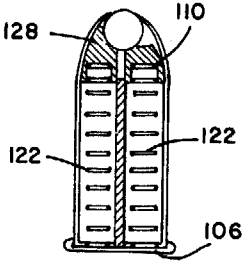
FIG. 15 is a lateral sectional view similar to FIG. 12 but without cartridges contained therein.
Figure 4:
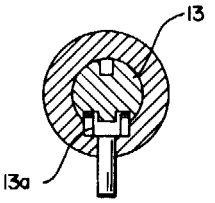
FIG. 4 is a sectional view taken along lines 4—4 in FIG. 1.
Figure 13:
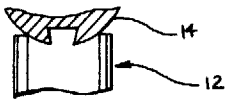
FIG. 13 is a fragmentary sectional view showing the receiver connection to the barrel.

Since firearm 10 is of the semi-automatic type, it is necessary to provide some means for extracting and ejecting each shell after firing. As shown in FIG. 2, the present disclosure provides an extractor and ejector assembly 22 that is adapted to extract and eject each shell after firing.

Viewing the firearm 10 in greater detail, it is seen that a bolt 26 is slidably mounted on a guide 13a formed within the receiver chamber 13. Formed along the underside of the bolt 26 is a cartridge feed guide 27 which, as will be described in greater detail subsequently, functions to engage the upper most cartridge of the cartridge feed means and to urge that cartridge into the receiver 12 toward a firing point and into a firing chamber therein. More particularly, the firing position is that position assumed by a respective cartridge just prior to being fired. As seen in FIG. 1, the cartridge denoted by the letter C is disposed in the firing position and as seen therein is in alignment with the bolt 26.

Slidably disposed above the bolt 26 is a firing pin 28, the front portion of the firing pin being aligned so as to engage the cartridge C disposed in the firing chamber. A retracting spring 30 engages a front portion of the firing pin 28 and biases the same rearwardly from the firing position.

Fixed to the bolt 26 and extending rearwardly therefrom through the receiver chamber 13 is a bolt shaft 32 that has a stop 34 fixed intermediately thereon. In order to bias the bolt toward the firing chamber, a return spring 36 is interposed between the stop 34 and a rear portion of the receiver unit 12 (FIG. 1). The return spring 36 is normally held in compression and exerts a forward force against the stop 34 and consequently biases the bolt 26 forwardly, as viewed in FIG. 1. To confine the return spring 36 and to allow the shaft 32 to freely reciprocate within the receiver chamber 13, a sleeve 38 is disposed within the receiver chamber 13 and is disposed to coaxial relationship with the bolt shaft 32.

Disposed within the receiver chamber 13 rearwardly of the bolt 26 and firing pin 28 is a spring loaded striker 40. Striker 40 is slidably mounted within the receiver chamber 13 and is generally aligned with the firing pin 28 and bolt 26 and is particularly adapted to strike the firing pin with an impact great enough to cause the firing pin to fire the cartridge C. Viewing the striker 40 in detail, it is seen that it is an open, generally cylindrical type structure having a head 40*a*, a front cylindrical wall 40*b* and a rear cylindrical wall 40*c*. The head 40*a* includes an opening therein for receiving the bolt shaft 32 and consequently allows the bolt to move independently of the striker 40. The flange area between the front and rear cylindrical walls 40*b* and 40*c* serves as a sear latch and is denoted in the drawings as 40*d*.

To bias the striker 40 toward the firing pin 28, there is provided a striker spring 42 that is disposed outwardly of the bolt return spring 36 and is held between a rear portion of the receiver 12 and the inner flange area between the front and rear walls 40*b* and 40*c*.

Turning to a detail discussion of the trigger mechanism 18, a trigger 44 is movably mounted within the receiver 12 and extends downwardly therefrom through a trigger guard. A trigger link 46 forms a part of the trigger structure 44 and is spring biased by a trigger spring 48 that normally urges the trigger 44 toward a forward position. Pivotably mounted to the trigger link 46 by a pivot pin 52 is an interconnecting link 50. The interconnecting link 50 is biased clockwise, as viewed in FIG. 1, by a spring and plunger assembly 59 that extends rearwardly from the trigger structure 44 and engages the lower end of the interconnecting link 50. Clockwise movement of the interconnecting link 50 is normally limited by a guide stop 54 secured to the receiver 12 and extending horizontally across the path of the upper portion of the link 50.

Interconnecting link 50 includes an upper stop area 58*a* that normally engages a sway link 56, the sway link being pivotably mounted to the receiver 12 about a transverse axis and normally biased for counterclockwise movement by a spring 58. As particularly seen in FIG. 1, the front end of the sway link 56 is secured to a sear 60 by a pin 62. Because sway link 56 is biased counterclockwise, as viewed in FIG. 1, the upper portion of the sear 60 is biased upwardly through the receiver chamber 13 and is adapted to engage the flanged sear latch area 40*d* formed about the striker 40. Also, it is seen that the upper portion of the sear 60 is cammed. This cammed upper portion allows the striker to move rearwardly therepast depressing the sear 60 until the latched area 40*d* passes the upper portion of the sear. Because the sway length 56 is biased counterclockwise, once the flange area 40*d* passes the sear 60, the sear is urged upwardly through the receiving chamber 13 where it serves as a stop and prevents the striker from moving forward to strike the firing pin 28.

In order to prevent the inadvertent firing of a firearm 10, a safety interlock mechanism 20 is operatively interconnected to the trigger mechanism 18. Viewing the safety interlock 20 in greater detail, it is seen that a safety shaft 64 extends through a longitudinal chamber 65 formed within the receiver 12, as best seen in FIG. 1. Safety rod 64 also extends through an opening in the sear 60. Formed on the end of the safety rod that extends as through the sear 60 is a safety stop 66, the safety stop being of greater diameter than the safety rod 64 and having an outside diameter slightly less than the inside diameter of the opening through the sear. Thus, it is appreciated that by positioning the safety rod such that the stop 66 is disposed within the opening through the sear 60 prohibits the sear from being moved up and down, consequently preventing inadvertent actuation of the trigger mechanism 18.

To actuate the safety rod 64, there is provided a thumb switch 68 which is slidably mounted on a slide surface 70 disposed rearwardly of the receiver 12. Switch 68 includes a pin 78 that is disposed rearwardly of a pair of notches 72 formed on the underside of the slide surface 70. A spring 76 is interposed between the underside of the slide surface 70 and the locking pin 78, and includes a forward curled position adapted to engage the notches 72. Therefore, as viewed in FIG. 1, positioning the thumb switch 68 such that it is in the rear most position results in the safety being "on". On the other hand, the positioning of the thumb switch 68 in the forward most position has the effect of removing the safety stop 66 from the opening within the sear 60 and consequently the safety is "off".

The firearm 10 may be manually cocked by a finger lever 80 which is pivotably mounted to a toggle link 84 by a pivot pin 82. The toggle link 84 is in turn pivotably mounted to the receiver 12 by a pivot pin 86. The upper portion of the finger lever 80 is pivotably connected to a loading slide 88, the loading slide being disposed on the guide structure 13*a* of the receiver chamber 13 and particularly spaced forwardly of a flanged area of the bolt 26. The guide is engageable with the flange area for moving the entire bolt 26 rearwardly against the striker for effectuating a manual cocking of the same.

Consequently in those cases where the striker is not cocked by the recoil movement of the bolt 26, a manual cocking may be realized by pivoting the finger lever 80 about the pivot pin 82. In order to move the loading slide 80 rearwardly, it becomes necessary for the toggle link 84 to pivot clockwise about the pivot pin 86. Therefore, as the toggle link 84 pivots clockwise, the finger lever 80 is free to pivot counterclockwise, thereby allowing the loading slide 88 to engage the bolt 26 and push the same rearwardly against the striker 40 and move the same rearwardly past the sear 60 to the cocked position, as illustrated in FIG. 1.

The extractor and ejector assembly, as viewed in FIG. 2, is carried by the bolt 26. With reference to the extractor and ejector assembly 22, it is seen that this assembly basically comprises an extractor 90 and an ejector 92, both the extractor and ejector being pivotaly mounted by a pin 93 along side the bolt 26. Disposed within the bolt 26 is a pair of spaced apart spring and plunger assemblies 94 and 96, spring and plunger 94 being engaged with the rear end of extractor 90 and biasing the head thereof inwardly relative to the receiving chamber 13 and spring and plunger assembly 94 being engaged with the front portion of the ejector 92 and biasing the same outwardly toward the wall structure of the receiving chamber.

Disposed within the receiving chamber 13 adjacent the firing chamber where the rim of the cartridge is disposed when the cartridge is positioned in the firing position, is an extractor cam 98. The extractor cam 98 is aligned with the head of the extractor 90 and functions to bias the same around the forward edge of the cartridge rim such that upon recoil, the extractor 90 functions to pull the shell rearwardly. As the shell is being pulled rearwardly, by the extractor 90, the ejector 92 engages a forward cam surface 100 (FIG. 2) formed along the edge of the receiving chamber 13. This first ejector cam 100 causes the head of the ejector 92 to slightly engage the cartridge shell so as to maintain alignment thereof as the shell is being extracted.

Spaced rearwardly of the forward ejector cam 100 is a second ejector cam 102. The second ejector cam 102 further engages the ejector 92 biasing it still further inwardly toward the center of the receiving chamber. As the ejector 92 moves inwardly after engaging the second ejector cam 102, the shell is ejected through an opening formed in the side of the receiving chamber 13.

The cartridge feed means indicated generally at 24 is in the form of a magazine clip and is adapted to be inserted into the lower portion of the receiver 12 such that the top of the clip extends adjacent a receiver chamber opening formed just beneath the normal position of the cartridge guide 27 carried by bolt 26. To maintain the magazine clip within the receiver 12, a clip lock 106 is pivotably mounted to the receiver and has a locking end that is engageable with the outside of the magazine clip for holding the same within the receiver.

Figure 12:
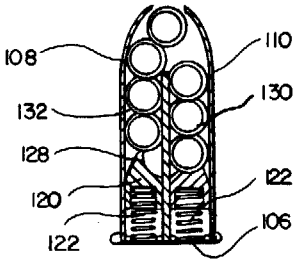
FIG. 12 is a sectional view of magazine clip taken along lines 12—12 of FIG. 6.
Figure 3:
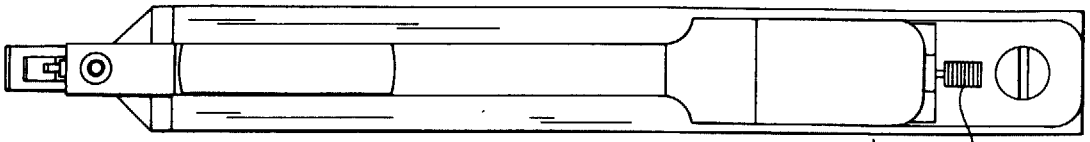
FIG. 3 is a bottom plan view of the portion of the firearm shown in FIG. 2.
Figure 7:
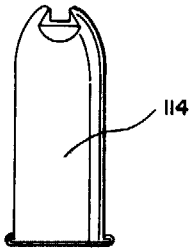
FIG. 7 is an end elevational view of the same.
Figure 11:
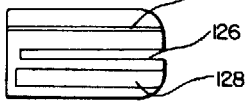
FIG. 11 is a top plan view of the guide plate.

Turning to FIGS. 5 through 12, the magazine clip of the present invention is shown therein and basically comprises a bottom plate 106 having a pair of spaced apart sides 108 and 110 extending upwardly therefrom. As illustrated in FIG. 12, the upper portion of the sides 108 and 110 are converged inwardly toward each other defining an opening about the top of the clip just large enough for a single cartridge to exit therefrom. The magazine clip also includes front and rear end plates 112 and 114 respectively, with each end plate extending between the two sides 108 and 110.

One significant feature of the magazine clip 24 is that its design permits two rows of cartridges to be placed therein. To accomplish this, a center partition wall 116 extends upwardly from the bottom plate 106 dividing the clip 124 into two separate cartridge chambers 130 and 132. A front portion of the partition 116 extends forwardly and is confined within a partition guide 118 disposed along the front edge of the magazine clip 24. A guide plate 120 is disposed within the clip 24 and is supported about the underside thereof by a plurality of springs 122, the springs extending between the bottom plate 106 and the guide plate 120 and normally biasing the guide plate upwardly toward the top opening of the clip.

More particularly, the guide plate 120 includes a pair of elongated cavities 124 formed in the underside thereof. These cavities 124 receive the top portion of the springs 122. Additionally, the guide plate 120 includes a rectangular partition cutout 126 which provides an opening for the center partition 116. Since only one cartridge at a time can exit through the top opening of the clip 24, it becomes desirable to stagger the individual cartridges of each row such that only one cartridge at a time enters the upper most area thereof. To accomplish this staggering, the guide plate 120 is provided with an elevated side 128 which elevates the cartridges disposed thereover approximately one-half a cartridge width relative to the adjacent row. The effect of such elevation assures alternate row cartridge feeding.

In operation, before firing the striker 40 is normally in the cocked position as shown in FIG. 1 and a cartridge C is positioned in the firing chamber also as illustrated in FIG. 1. Upon actuating the trigger mechanism 18, the sear 60 is disengaged from the striker 40 allowing the latter to move forward and impact against the firing pin 28, which in turn fires the cartridge C. The firing of the cartridge C results in a recoil movement of the bolt 26. As the bolt 26 recoils, the extractor and ejector assembly 22 is operative to extract and eject the fired shell. The bolt 26 continues to recoil and engages the head 40a of the striker 40 and pushes the same back to the cocked position where the sear 60 engages the flanged area 40d to hold the striker in this cocked position. Thus in this type of operation the firearm 10 is recocked by the recoil movement of the bolt 26 and consequently can be appropriately termed a semi-automatic firearm.

But in cases where the striker has been released from the sear 60 and there is no cartridge to yield the recoil movement, the firearm of the present invention may be manually cocked. This manual cocking is accomplished by pivoting the finger lever 80 counterclockwise about pivot pin 82. As the finger lever 80 is so pivoted, the loading guide 88 urges the bolt 26 rearwardly against the edge of the striker 40. As the bolt 26 is urged rearwardly, the striker passes the sear 60 and the sear engages the flanged area 40d and consequently the striker is held in the cocked position and is ready for firing.

It is appreciated that after each firing and after the bolt has recoiled, the bolt is then urged forward by the presence of the return spring 36. During this return movement, the cartridge feed guide 27 engages the upper most cartridge of the clip 24 and urges the same into the receiver 12 and on into the firing chamber as indicated by cartridge in FIG. 1.

Figure 6:
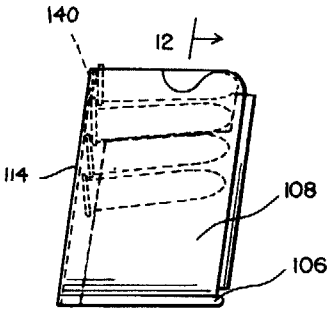
FIG. 6 is a side elevational view of the magazine clip.
Figure 10:
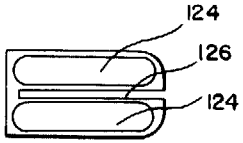
FIG. 10 is a bottom plan view of a guide plate utilized by the magazine clip to support each row of cartridges.
Figure 9:
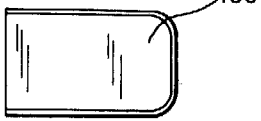
FIG. 9 is a bottom plan view of such clip.
Figure 5:
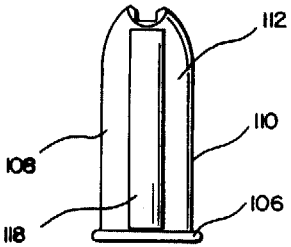
FIG. 5 is a front elevational view of the magazine clip utilized by the firearm of the present invention.
Figure 8:
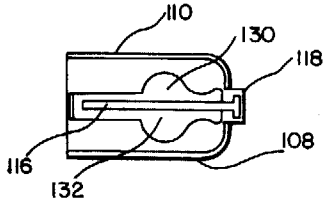
FIG. 8 is a top plan view of the magazine clip.

Finally, as best seen in FIG. 6, it is noted that the center partition 116 generally acts to prohibit the cartridges from moving forward in the magazine clip since the rear rim portion of each cartridge shell overlaps the plane of the partition. Also, as illustrated in FIG. 6, the magazine clip includes an upper cam 140 disposed interiorly of the clip along an upper portion of the rear wall 114. This cam acts to urge the upper most cartridge forwardly within the magazine clip which facilitates the feeding of the individual cartridges into the receiver.

From the foregoing it is clear that the disclosure of the present invention provides a simple yet efficient semi-automatic firearm that is relatively inexpensive to produce. The present invention also provides an improved clip means for use with firearms that is reliable for use over an extended period.

The terms "upper", "lower", "forward", "rearward", etc., have been used herein merely for the convenience of the foregoing specification and in the appended claims to describe the semi-automatic firearm and its parts as oriented in the drawings. It is to be understood, however, that these terms are in no way limiting to the invention since the semi-automatic firearm may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range are intended to be embraced herein.

What is claimed is:

1. In a firearm having means for inserting one cartridge at a time into a chamber, the improvement comprising: a magazine adapted to hold a plurality of cartridges, said magazine including a pair of side-by-side cartridge chambers separated by a partition extending longitudinally through said magazine and laterally in spaced relationship to the rear wall thereof, the upper outer side of each cartridge chamber being tapered inwardly toward each other so as to converge the upwardly moving cartridges of each chamber into single file for feeding to the firearm chamber.

2. The magazine of claim 1 wherein a biasing means is provided within each magazine chamber for moving said cartridges upwardly toward the single file opening between the upper outer sides of said chambers.

3. The magazine of claim 2 wherein the biasing means are springs.

4. The magazine of claim 2 wherein the cartridge engaging portion of the biasing means form a shell contouring cradle when in the uppermost position thereby assuring smooth single file feed.

* * * * *